US006817113B2

(12) United States Patent
Pan

(10) Patent No.: US 6,817,113 B2
(45) Date of Patent: Nov. 16, 2004

(54) FOOTWEAR HAVING COMPACTED PORTION AND DESIGN

(76) Inventor: Kung-Sheng Pan, 7F, No. 19-28, Chung Yung Rd., Nan Tun Area, Taichung (TW)

( * ) Notice: Subject to any disclaimer, the term of this patent is extended or adjusted under 35 U.S.C. 154(b) by 9 days.

(21) Appl. No.: 10/424,927

(22) Filed: Apr. 29, 2003

(65) Prior Publication Data

US 2003/0208925 A1 Nov. 13, 2003

(30) Foreign Application Priority Data

May 13, 2002 (TW) ..... 91207001 U

(51) Int. Cl.[7] ..... A43B 3/12
(52) U.S. Cl. ..... 36/11.5; 36/141; 36/8.1
(58) Field of Search ..... 36/11.5, 8.1, 3 R, 36/3 B, 141, 26

(56) References Cited

U.S. PATENT DOCUMENTS

| | | | | | |
|---|---|---|---|---|---|
| 2,284,947 | A | * | 6/1942 | Clifford | 36/44 |
| 5,930,916 | A | * | 8/1999 | Connor | 36/11.5 |
| 5,992,055 | A | * | 11/1999 | Connor | 36/43 |
| 6,003,246 | A | * | 12/1999 | Pan | 36/11.5 |
| 6,014,821 | A | * | 1/2000 | Yaw | 36/8.1 |
| 6,029,372 | A | * | 2/2000 | Pan | 36/11.5 |
| 6,735,885 | B2 | * | 5/2004 | Yaw | 36/11.5 |
| 2003/0208924 | A1 | * | 11/2003 | Pan | 36/11.5 |

* cited by examiner

*Primary Examiner*—M. D. Patterson
(74) *Attorney, Agent, or Firm*—Bacon & Thomas PLLC

(57) ABSTRACT

A footwear is constructed to include a sole provided with a breathable body at the top and an upper fastened to the sole for securing a foot. The breathable body is made of a plurality of intertwined elastic filaments having a compacted portion in an area in the breathable body and a design impressed on a surface of the compacted portion.

7 Claims, 3 Drawing Sheets

FOOTWEAR HAVING COMPACTED PORTION AND DESIGN

BACKGROUND OF THE INVENTION

1. Field of the Invention

The present invention relates general to a footwear and, more particularly, to a footwear having a compacted portion and impressed design.

2. Description of the Related Art

A footwear is known consisting of a sole, a strap fastened with an upper surface of the sole, and a breathable body which is made of a plurality of elastic filaments and is attached to the upper surface of the sole.

The breathable body must be cut subject to one of a series of shapes, and the different shapes of breathable body must be sorted and selected. However, when a different shape of breathable body is used, the positioning and assembling of the selected shape of breathable body in the sole may cause a problem.

Further, there is a compacted groove formed on the breathable body of the footwear disclosed before, but it cannot provide the variety of styling and impressed design.

SUMMARY OF THE INVENTION

The present invention has been accomplished under the circumstances in view.

It is one object of the present invention to provide a footwear, which enables the breathable body to be compacted into any of a variety of shapes.

It is another object of the present invention to provide a footwear, which further has a impressed design on a surface of the compacted portion.

To achieve these and other objects of the present invention, the footwear comprises a sole made subject to a predetermined shape; a breathable body provided in an upper surface of the sole, the breathable body being made of a plurality of elastic filaments, the elastic filaments being intertwined to form a network body having a thickness and a plurality of spaces; and an upper connected to the sole for securing a foot. The breathable body comprises a compacted portion in an area in the breathable body, and a design impressed on a surface of the compacted portion.

DETAILED DESCRIPTION OF THE PREFERRED EMBODIMENT

Figure 1:
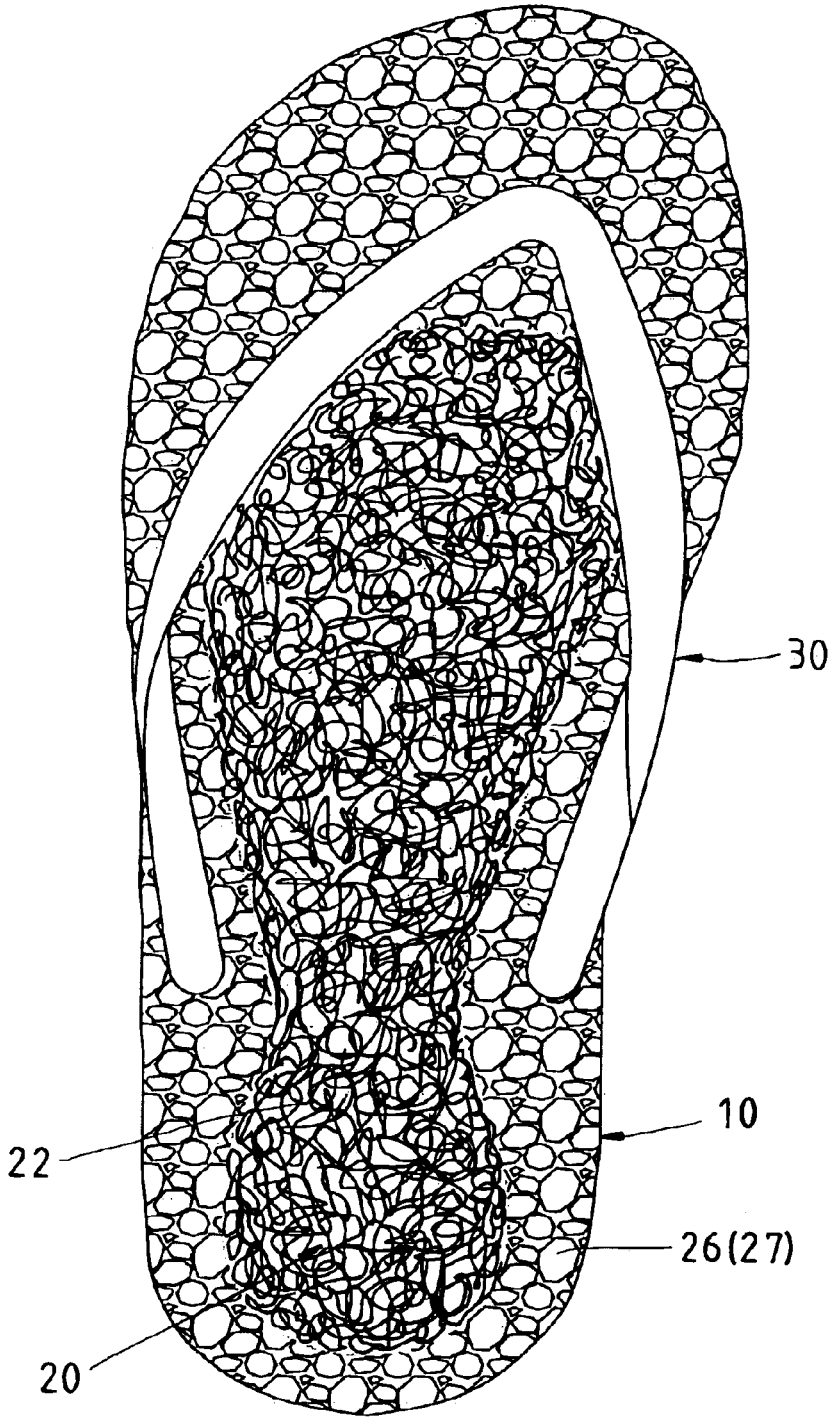
FIG. 1 is a top view of a footwear according to the present invention.
Figure 2:
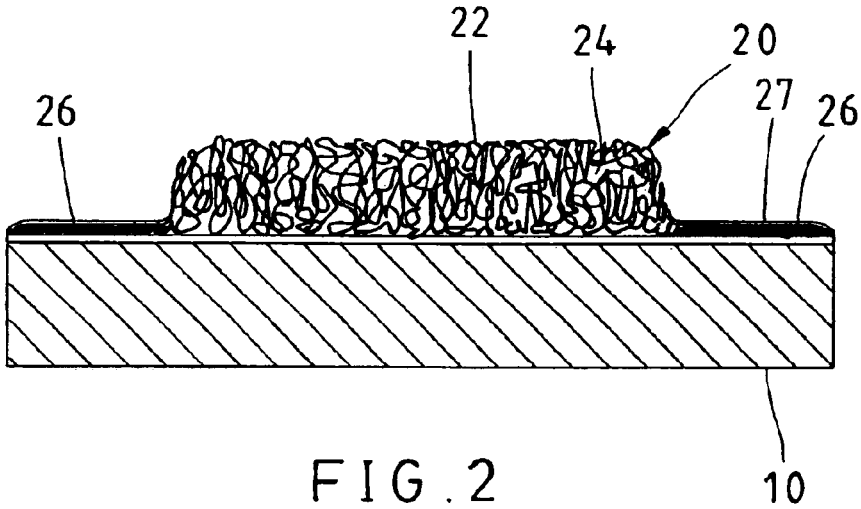
FIG. 2 is a sectional view taken along line 2—2 of FIG. 1.

Referring to FIGS. from 1 through 4, a footwear in accordance with the present invention is shown comprised of a sole 10, a breathable body 20, and an upper 30.

The sole 10 is made of a rubber, plastic, or leather material having an appropriate pliability and cut into shape fitting the sole of the foot.

The breathable body 20 is formed of elastic filaments 22 of polyvinyl chloride. The filaments 22 are intertwined to form an intricate network body of an appropriate thickness and having a number of gaps 24 provided in the upper surface of the sole 10. The breathable body 20 has a compacted portion 26 in a particular area, for example, the border area, and a design 27 impressed on the surface of the compacted portion 26 by a transfer-printing apparatus. The design 27 can be a colored graphic design or letters.

The upper 30 can be of any of a variety of shapes fixedly fastened to the sole 10 for securing a foot. The upper 30 is disposed above the sole 10, defining with the sole 10 a space for receiving a foot.

The breathable body 20 is adhered to the upper surface of the sole 10. The gaps 24 serve as a ventilation system for driving out the foul air as well as the foot perspiration, providing a wearing comfort, a massaging effect of the foot sole, and a friction between the foot sole and the breathable body.

Figure 3:
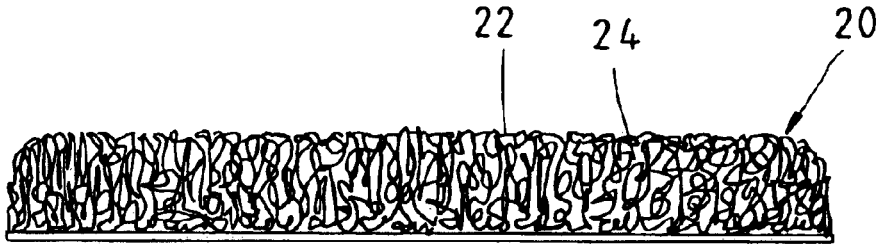
FIG. 3 is a side view in section of the footwear according to the present invention.
Figure 4:
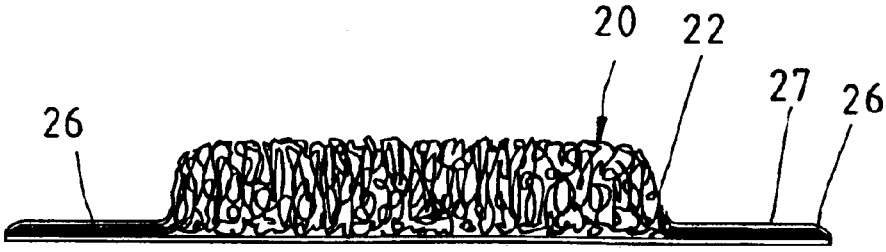
FIG. 4 is a side view in section of the footwear according to the present invention, showing the border area of the footwear compacted.

The formation of the footwear is outlined hereinafter. At first, a breathable body 20 is prepared as shown in FIG. 3, and then a heat sealing apparatus (not shown) is used to compact the assigned area of the breathable body 20, forming a compacted portion 26 in the breathable body 20, and then a transfer-printing apparatus is used to impress the desired design 27 in the compacted portion 26. The processed breathable body 20 thus obtained is then adhered to the upper surface of the sole 10.

Because the border area of the breathable body 20 is compacted into the compacted portion 26, the cut ends of the elastic filaments 22 in the border of the breathable body 20 are compacted and merged into the compacted portion 26. Therefore, the elastic filaments 22 do not come off easily.

Further, the breathable body 20 can be embossed with the desired design.

Figure 5:
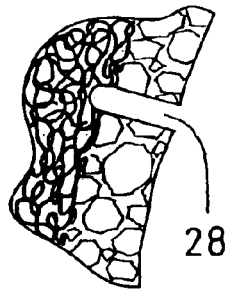
FIG. 5 is sectional view of a part of the present invention, showing a notch formed in the compacted portion of the breathable body.

Referring to FIG. 5, the compacted portion 26 of the breathable body 20 is peripherally cut, forming a number of notches 28 for carrying off water.

Figure 6:
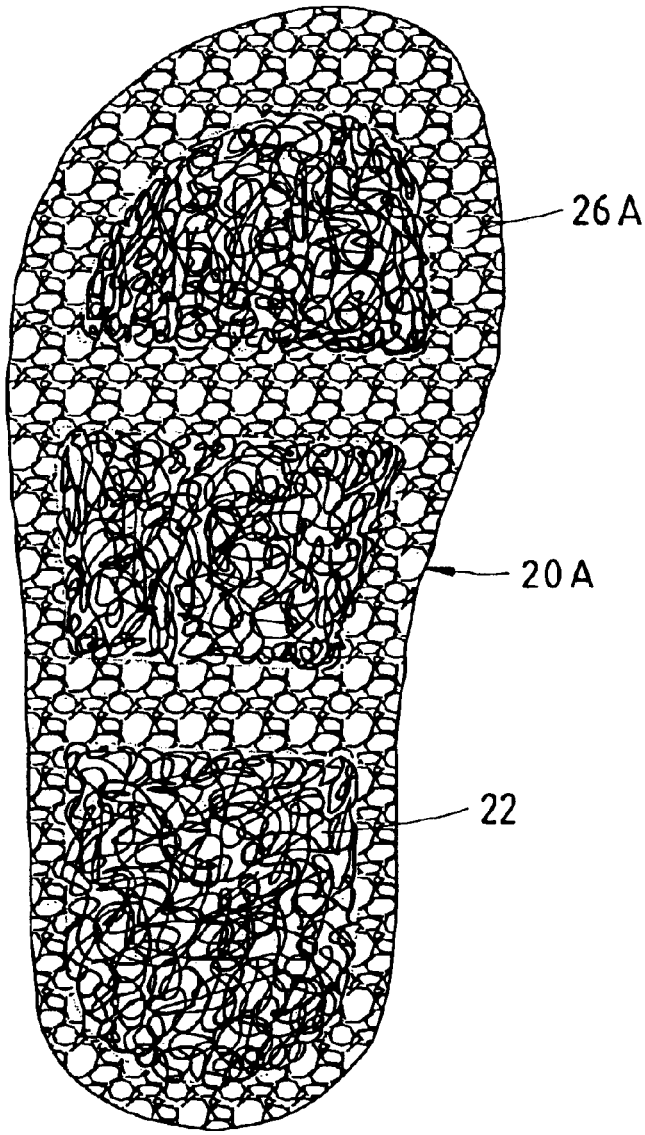
FIG. 6 is a top view of an alternate form of the footwear according to the present invention (the upper eliminated).

FIG. 6 shows an alternate form of the present invention. According to this embodiment, the compacted portion 26A of the breathable body 20A is formed by means of the application of a heat press. The compacted portion 26A, divides the elastic filaments of the breathable body 20 into multiple blocks.

A protocol of footwear has been constructed with the features of FIGS. 1~6. The footwear functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

As indicated above, the footwear of the present invention has the following advantages:

1. The footwear of the present invention, wherein the filaments of the breathable body can be compacted, and the surface of the compacted portion further can be impressed any kind of pattern or drawing or text, then providing variety of shapes.

2. The footwear of the present invention, wherein the compacted portion of the breathable body can be formed by heating molding directly, do not need cutting parts and assembly of the cutting parts, then providing the convenience of production.

What the invention claimed is:

1. A footwear comprising:

a sole made subject to a predetermined shape;

a breathable body provided in an upper surface of said sole, said breathable body being made of a plurality of elastic filaments, said elastic filaments being intertwined to form a network body having a thickness and a plurality of spaces;

an upper connected to said sole for securing a foot; and wherein said breathable body comprises a compacted portion in an area in said breathable body and a design impressed on a surface of said compacted portion.

2. The footwear as claimed in claim 1, wherein said compacted portion is formed in the border of said breathable body.

3. The footwear as claimed in claim 1, said compacted portion divides said elastic filaments of said breathable body into at least two blocks.

4. The footwear as claimed in claim 1, wherein said compacted portion is formed by means of a heat-sealing process.

5. The footwear as claimed in claim 1, wherein said compacted portion of said breathable body each has a notch.

6. The footwear as claimed in claim 1, wherein said design of the breathable body is a colored impressing design.

7. The footwear as claimed in claim 1, wherein said design is an embossed design formed by the material of the breathable body itself.

* * * * *